United States Patent [19]

Feurt

[11] Patent Number: 4,784,078

[45] Date of Patent: Nov. 15, 1988

[54] FLOATING SMALL BOAT CLEANING FACILITY

[76] Inventor: Leo D. Feurt, 12709 Kaitz, Poway, Calif. 92064

[21] Appl. No.: 135,734

[22] Filed: Dec. 21, 1987

[51] Int. Cl.[4] ..... B63B 59/00

[52] U.S. Cl. ..... 114/222; 15/1.7; 15/DIG. 12

[58] Field of Search ..... 114/222, 45; 15/1.7, 15/DIG. 2

[56] References Cited

U.S. PATENT DOCUMENTS

| | | | |
|---|---|---|---|
| 3,561,391 | 2/1971 | Locati | 114/222 |
| 3,752,109 | 8/1973 | Seiple | 114/222 |
| 4,092,943 | 6/1978 | Lund et al. | 114/222 |

FOREIGN PATENT DOCUMENTS

| | | | |
|---|---|---|---|
| 122093 | 6/1986 | Japan | 114/222 |

*Primary Examiner*—Joseph F. Peters, Jr.
*Assistant Examiner*—Jesüs D. Sotelo
*Attorney, Agent, or Firm*—Charles C. Logan, II

[57] ABSTRACT

Floating small boat cleaning facility formed from a floating dock assembly having a pair of laterally spaced longitudinally extending side walls, a front entrance end wall, a rear exit end wall, a bottom wall, and a top wall spaced downwardly from the top edge of the side walls, to form a buoyancy chamber. The outside surface of the side walls have brackets to receive anchor pilings that have their bottom ends secured to the sea bottom. The front end wall and the rear end wall have a cutout portion formed adjacent their top edge and a plurality of vertically oriented strips of flexible material have their bottom ends attached to this top edge to form an entrance curtain and an exit curtain through which boats may pass. The curtains have structure for maintaining them in a floating substantially vertical orientation. As a boat passes through the entrance curtain, its presence is detected and signals are transmitted to the central control and computer room which controls the drive wheels that carry the boat through the floating dock assembly. As the boat progresses through the floating dock assembly, its presence is further detected which causes the brush wheel assemblies to be actuated for cleaning the water surface area of the boat.

10 Claims, 3 Drawing Sheets

FLOATING SMALL BOAT CLEANING FACILITY

BACKGROUND OF THE INVENTION

This invention relates to apparatus for scrubbing the hull of a boat, and more particularly to such apparatus which scrubs the hull of a boat clean of marine growth, scum, oil and the like, without removing the boat from the water.

The need for a boat bottom cleaning apparatus is well known in the art. This need is due to the fact that a boats performance, is related to the ability of the boat hull to slide through the water. If the boat hull is dirty or should various under water marine growth be attached to the hull, the performance of the boat will be substantially diminished. In the past, various types of anti-fouling and toxic bottom paints have been used on boat hulls. However, such paints have been found ineffective in preventing multiplicity of types of marine growth which are known to grow on ships hulls. When hulls having these paints on are cleaned in the water, toxic chemicals such as mercury are removed from the surface of the paint and these are allowed to be deposited in the water surrounding the hull of the boat.

It is an object of the invention to provide a novel floating dock assembly that will allow boats to have their bottom hulls cleaned of marine growth without the necessity of removing the boats from the water.

It is also an object of the invention to provide a novel floating dock assembly that will collect the toxic debris which is removed from the hulls of the boats, thereby, not contaminating the surrounding water.

It is another object of the invention to provide a novel floating dock assembly whose height can be raised or lowered with respect to the surrounding water.

It is an additional object of the invention to provide a novel floating dock assembly having electronic equipment that is computerized so that the boat hull may be detected upon its entrance into the floating dock assembly and at various stages along its path of travel, the operations of brushing its water line area and producing a picture of the contour of the boat hull can be obtained for programming the hydro-cleaning robots mounted within the floating dock assembly.

It is a further object of the invention to provide a novel entrance curtain and an exit curtain through which the boats may pass while effectively maintaining a wall to prevent the entrance of marine life.

SUMMARY OF THE INVENTION

Applicant's novel floating small boat cleaning facility is basically formed from a floating dock assembly having a pair of laterally spaced longitudinally extending side walls, a front entrance end wall, a rear exit end wall, a bottom wall, and a top wall spaced downwardly a predetermined distance from the top edge of the side walls, these previously recited walls forming a buoyancy chamber between them.

The floating dock assembly has guide brackets extending laterally from the outside surface of the side walls and these capture the top ends of anchor pilings whose bottom ends are secured to the sea bottom. This structure along with a pumping system which can be used to vary the amount of water contained in the buoyancy chamber allows the floating dock assembly to be raised and lowered when desired.

The front entrance end wall and the rear exit end wall have a cut out portion formed adjacent its top edge, and a plurality of vertically oriented strips of flexible material having their bottom ends attached to the top edge of the cutout portion form entrance curtains and exit curtains through which boats may pass. Floats are attached to the vertical strips to enable them to maintain a substantially vertical orientation. Additionally, an air bubble system allows the release of air bubbles on both the front and rear surfaces of the curtains at their bottom end and these bubbles travel upwardly and perform the function of detering fish and other marine life from entering into the floating dock assembly through the curtains.

A plurality of photoelectric cells are positioned along the length of the side wall of the floating dock assembly and these perform several functions. The first one identifies the front of a boat traveling into the floating dock assembly and with this a signal is transmitted to the central control and computer room which then tells the drive wheel assemblies to be actuated to transport the boat through the floating dock assembly. Another set of photoelectric cells send a signal to actuate the brush wheel assembly for cleaning the water line of the boat hull. After this the next set of photoelectric cells actuate a bank of transducers which figure out the configuration of a ships hull and put this into the memory of the computer. This information will later be used when the boat hull is detected by another set of photoelectric cells that will actuate the hydro-cleaning robots and direct them to clean the entire bottom surface of the hull of the boat. The last set of photoelectric cells will detect the boat as it exits the rear end wall curtain.

As the debris of marine life and also particles of toxic material such as lead is removed from the outer surface of the boats hull, this material will settle on the top surface of the top wall of the floating dock assembly where there are a plurality of debris evacuation apertures that are in turn connected to a suction pump for removing the debris. The debris is drawn through a filter and thus removed. As a result the hull of the boats are completely cleaned without the necessity of removing them from the water, but more importantly, the toxic debris which has been removed is not released into the surrounding water where it can contaminate the marine life or cause human pollution.

DESCRIPTION OF THE PREFERRED EMBODIMENT

Figures 1, 2:
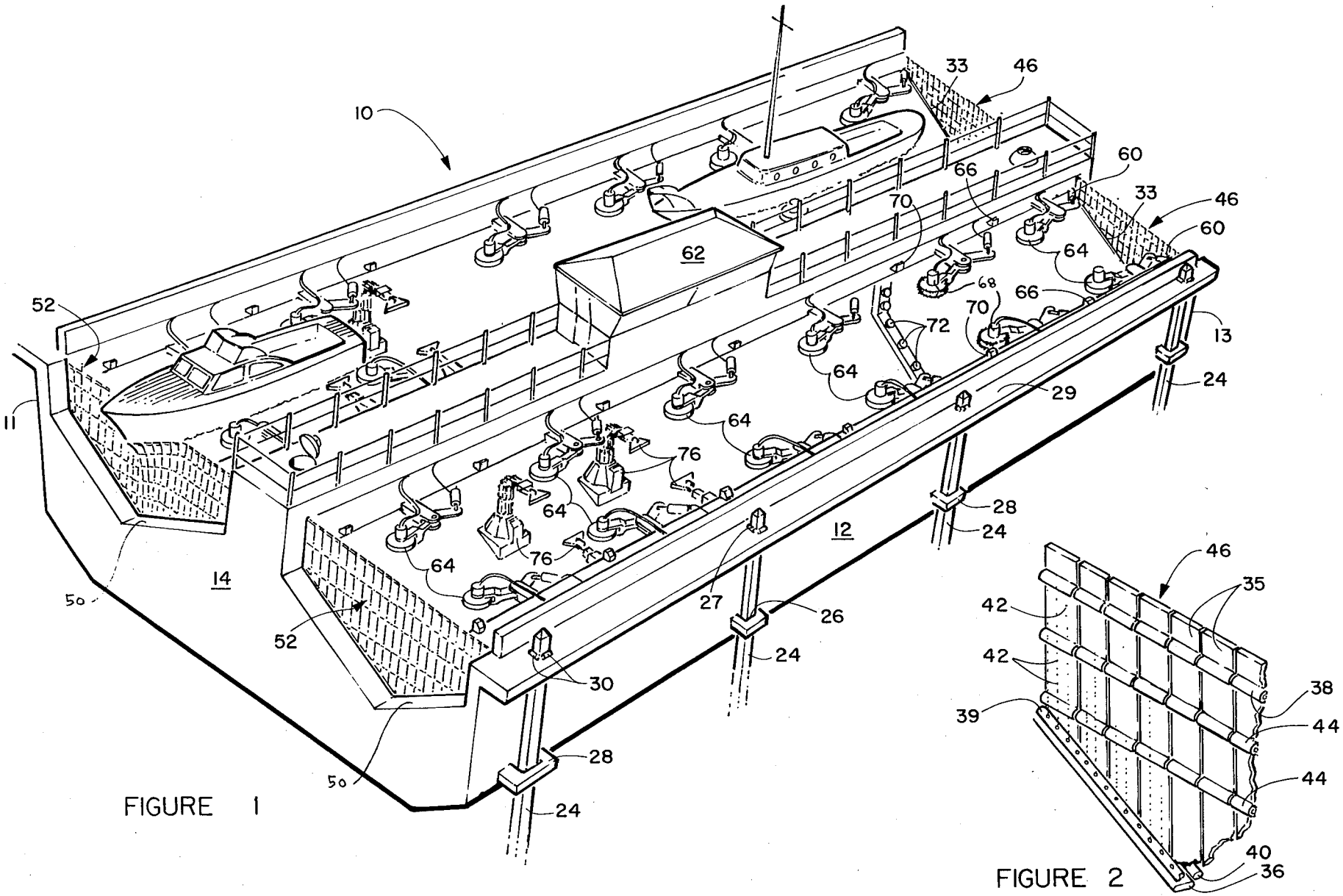
FIG. 1 is a perspective view of Applicant's novel floating small boat cleaning facility.
FIG. 2 is a partial perspective view of one of the end wall curtains.

Applicant's novel floating small boat cleaning facility is primarily formed from a floating dock assembly 10. It has a pair of side walls 11 and 12 a front entrance end wall 13, a rear exit end wall 14, a top wall 15, and a bottom wall 16. These walls form a buoyancy chamber 18 between them. Support beams 20 give integrity to top wall 15 and have their bottom ends connected to bottom wall 16.

Figure 3:
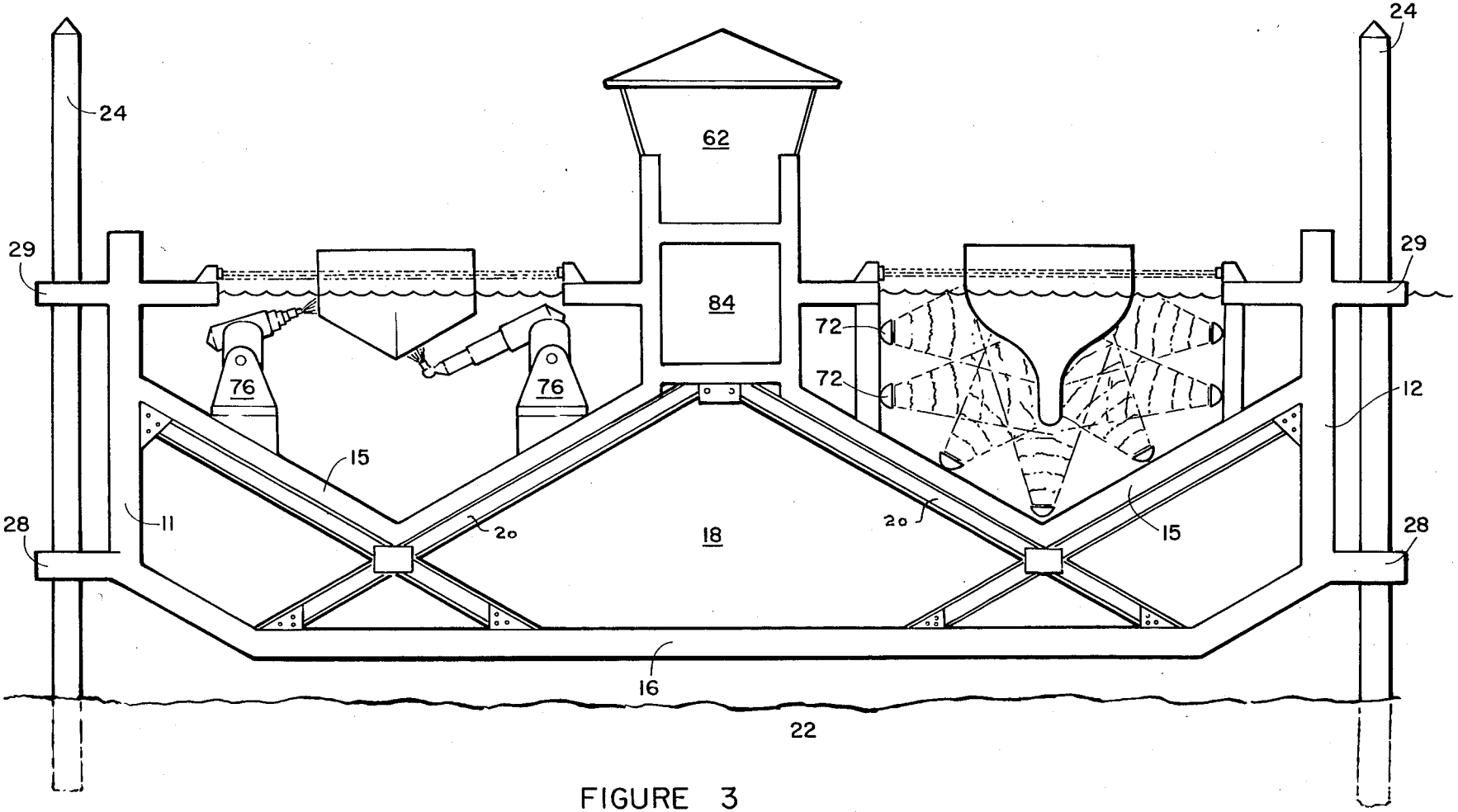
FIG. 3 is a schematic illustration of the internal structure of the floating dock assembly and the location of the different equipment for cleaning the boat hulls.

The structure for anchoring the floating dock assembly 10 to the sea floor 22 is best illustrated in FIGS. 1 and 3. A plurality of anchor pilings 24 have their bottom ends secured into the sea bottom 22. The top ends of the anchor pilings 24 are reciprically received in the slots 26 and 27 formed respectively in the guide brackets 28 and flange 29. Rollers 30 are mounted adjacent slots 27. By varying the amount of water contained in buoyancy chamber 18, the floating dock assembly 10 will rise or drop accordingly.

Front entrance end wall 13 has a pair of cutout portions 33 formed adjacent its top edge. A plurality of vertically oriented plastic strips 35 have their bottom ends connected to a bracket 36. Adjacent the top ends of the strips 35 foam floats 38 are attached to keep the strips vertically oriented. Additionally, pipes 39 and 40 are mounted on brackets 36 and these pipes have a plurality of apertures in them through which air bubbles 42 are released. These air bubbles travel upwardly along both sides of the strips 35 and some of them are captured by bubble traps 44 that are attached to these strips. These assembled strips 35 form an entrance curtain 46. The rear exit end wall 14 has cutout portion 50 therein and they have curtains 52 which are similar in structure to curtains 46.

The operation of the floating small boat cleaning facility will now be explained. As the front end of a boat passes through entrance curtain 46, its presence is detected by a set of photoelectric cells 60. This information is transmitted to a computer (not shown) in the central control computer room 62. The signal is sent out from the computer to the various drivewheel assemblies 64 which effectively grip the hull of the boat between them and as they rotate will cause the boat to travel throughout the length of the floating dock assembly. As the front of the hull of the boat reaches the set of photoelectric cell 66, this information is fed into the computer which in turn actuates brush wheel assemblies 68 which function to clean the water line surface of the boats hull. The next set of photoelectric cells to be triggered are designated numeral 70 and they inform the computer which in turn actuates a plurality of transducers 72. These transducers may be sonic or doppler and they function to give a visual picture of the contour of the hull of the boat to the computer which will later use this information by sending it to the hydro-cleaning robots 76. This information is used by these hydro-cleaning robots 76 to insure that they properly totally clean the entire bottom surface of the ships hull. As noted in FIG. 1, there are additional sets of photoelectric cells along the path of travel of the boat and these send information to the computer so that it may direct the appropriate drivewheel assemblies to operate to drive the hull through the floating dock assembly.

Figure 4:
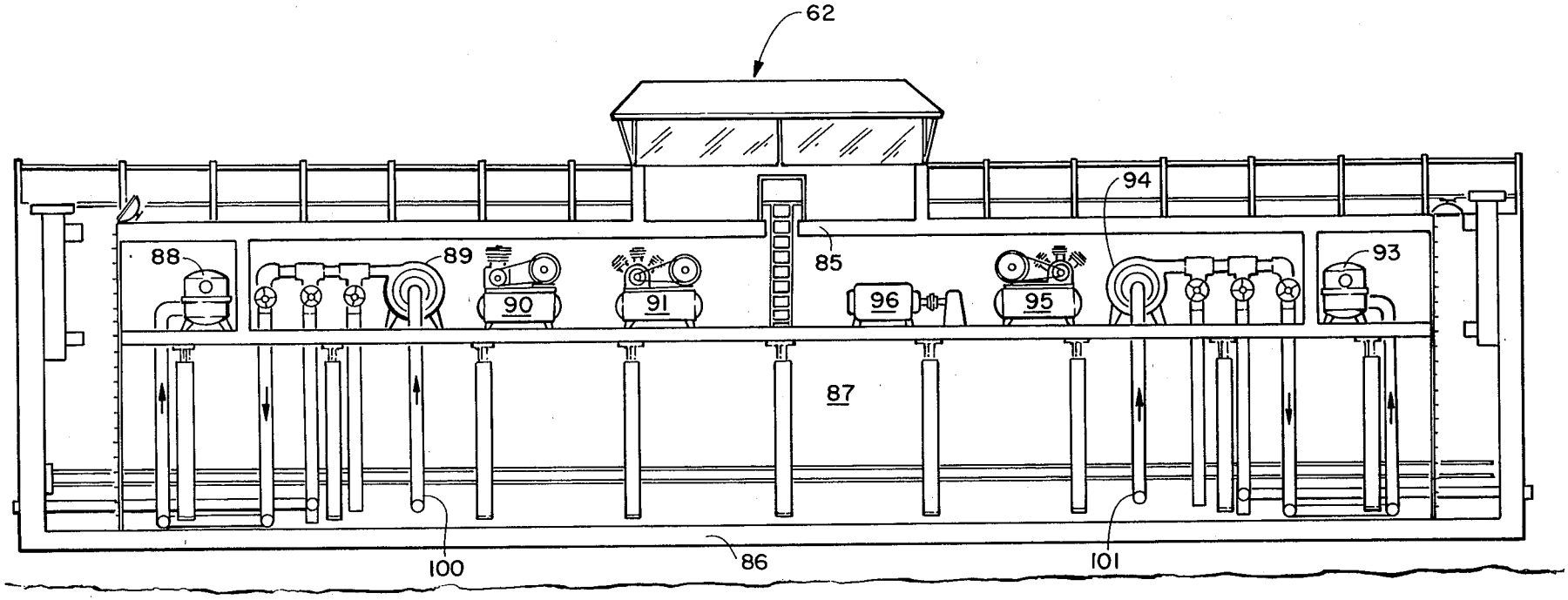
FIG. 4 is a schematic illustration detailing the layout of the equipment in the pump and compressor room of the floating dock assembly.
Figure 5:
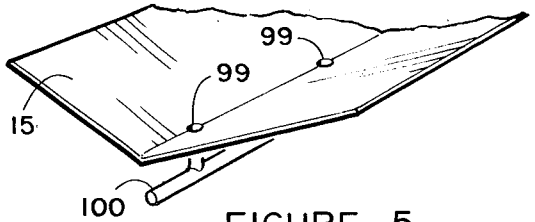
FIG. 5 is a partial perspective view of the top wall showing the drain apertures for collecting the debris removed from the bottom of the boats.

In FIGS. 3 and 4 it will be noted that the central control in the computer room 62 is mounted atop a pump and compressor room 84. This room has a top wall 85 and a bottom wall 86 and an equipment chamber 87 is formed therebetween. Located within equipment chamber 87 is a forward debris filter 88, a forward pump 89, a diving air compressor 90, and a forward bubble screen air compressor 91. The aft end of equipment chamber 87 has a debris filter 93, a pump 94, an aft bubble screen air compressor 95, and a hydraulic pump system 96 for the boat drive and water line wheelbrush assembly 68.

A plurality of apertures 99 are placed longitudinally along top wall 15 and these are connected by pipes 100 and 101 through pumps 89 and 94 respectively to the respective debris filters 88 and 93. Additional pipes are connected through valves (see FIG. 4) for pumping external water into buoyancy chamber 18 and also for evacuating buoyancy chamber 18.

What is claimed is:

1. A floating small boat cleaning facility comprising:

a floating dock assembly having a pair of laterally spaced longitudinally extending side walls each having a top edge, a front entrance end wall, a rear exit end wall, a bottom wall, and a top wall spaced downwardly a predetermined distance from the top edge of said side walls, these previously recited walls forming a buoyancy chamber between them:

means for anchoring said floating dock assembly to the sea floor comprising a plurality of guide brackets mounted on the outside surface of the side walls of said floating dock assembly, said guide brackets each having anchor piling slots, a plurality of vertically oriented anchor pilings having their bottom ends secured to the sea floor, each of said pilings having a portion thereof passing through the slots of said guide brackets;

said front entrance end wall having a cutout portion formed adjacent its top edge, a plurality of vertically oriented strips of flexible material have their bottom ends attached to the top edge of said front entrance end wall to form an entrance curtain through which boats may pass;

said rear exit end wall having a cutout portion formed adjacent its top edge, a plurality of vertically oriented strips of flexible material have their bottom ends attached to the top edge of said rear exit end wall to form an exit curtain through which boats may pass;

means for keeping said entrance curtain and said exit curtain floating in a substantially vertical orientation;

means for cleaning the hulls of boats brought into said floating dock assembly; and means for vacuuming the debris cleaned off the hulls of the boats from the top wall of said floating dock assembly.

2. A floating small boat cleaning facility as recited in claim 1 wherein said top wall has a generally V-shaped cross-sectional configuration.

3. A floating small boat cleaning facility as recited in claim 1 further comprising support beams for structurally supporting said top wall of said floating dock assembly above said bottom wall.

4. A floating small boat cleaning facility as recited in claim 1 further comprising means for filling said buoyancy chamber with a predetermined amount of water and for pumping out of said buoyancy chamber a predetermined amount of water to affect the height at which the floating dock assembly sits in the water.

5. A floating small boat cleaning facility as recited in claim 1 further comprising means for detecting the entrance of a boat through said front entrance curtain.

6. A floating small boat cleaning facility as recited in claim 1 further comprising means for driving a boat through said floating dock assembly.

7. A floating small boat cleaning facility as recited in claim 6 further comprising means for brushing the water line surface of a boat driven through said floating dock assembly.

8. A floating small boat cleaning facility as recited in claim 1 further comprising means for analyzing the contour of the hull of a boat passing through said floating dock assembly so that it may be throughly cleaned.

9. A floating small boat cleaning facility as recited in claim 1 wherein said means for cleaning the hulls of the boats comprises a plurality of hydro-cleaning robots mounted on the top wall of said floating dock assembly.

10. A floating small boat cleaning facility as recited in claim 1 further comprising means for releasing air bubbles along the bottom of said entrance curtain and said exit curtain.

* * * * *